US011047393B1

(12) United States Patent
Yamashita et al.

(10) Patent No.: US 11,047,393 B1
(45) Date of Patent: Jun. 29, 2021

(54) MULTI-STAGE CENTRIFUGAL COMPRESSOR, CASING, AND RETURN VANE

(71) Applicant: MITSUBISHI HEAVY INDUSTRIES COMPRESSOR CORPORATION, Tokyo (JP)

(72) Inventors: Shuichi Yamashita, Tokyo (JP); Akihiro Nakaniwa, Tokyo (JP); Yoshiaki Shoji, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 0 days.

(21) Appl. No.: 16/757,534

(22) PCT Filed: Nov. 29, 2018

(86) PCT No.: PCT/JP2018/043969
§ 371 (c)(1),
(2) Date: Apr. 20, 2020

(87) PCT Pub. No.: WO2019/107488
PCT Pub. Date: Jun. 6, 2019

(30) Foreign Application Priority Data

Nov. 29, 2017 (JP) ..... JP2017-229340

(51) Int. Cl.
*F04D 29/44* (2006.01)
*F04D 17/12* (2006.01)

(52) U.S. Cl.
CPC ..... *F04D 17/122* (2013.01); *F04D 29/444* (2013.01); *F05D 2240/122* (2013.01); *F05D 2250/70* (2013.01)

(58) Field of Classification Search
None
See application file for complete search history.

(56) References Cited

U.S. PATENT DOCUMENTS 3,802,795 A * 4/1974 Nyeste ..... F04D 25/028 415/122.1
3,825,368 A * 7/1974 Benjamin ..... F04D 17/122 415/199.2

(Continued)

FOREIGN PATENT DOCUMENTS

EP 2949946 A1 12/2015
JP S61-066899 A 4/1986

(Continued)

OTHER PUBLICATIONS

International Search Report in corresponding International Application No. PCT/JP2018/043969, dated Feb. 12, 2019 (4 pages).

(Continued)

*Primary Examiner* — Michael Lebentritt
(74) *Attorney, Agent, or Firm* — Osha Bergman Watanabe & Burton LLP

(57) ABSTRACT

A multi-stage centrifugal compressor includes: a rotary shaft that is configured to rotate around an axis; a plurality of stages of impellers that are fixed to the rotary shaft and are configured to integrally rotate to compress and deliver a fluid, which flows into the impellers from an upstream side in an axial direction, to a radial outer side; a casing including a return flow path that is configured to guide the fluid, which is compressed and delivered from an impeller on a preceding stage side, toward a radial inner side, and an introduction flow path that is connected to a downstream side of the return flow path and is configured to divert the fluid and introduce the fluid to an impeller on a succeeding stage side; and return vanes that are arranged in the return flow path while being spaced apart from each other in a circumferential direction.

10 Claims, 4 Drawing Sheets

(56) References Cited

U.S. PATENT DOCUMENTS

| | | | | |
|---|---|---|---|---|
| 4,645,419 | A * | 2/1987 | Furuya | F04D 29/444 415/208.2 |
| 4,938,661 | A * | 7/1990 | Kobayashi | F04D 29/444 415/199.1 |
| 2007/0140889 | A1* | 6/2007 | Chen | F04D 29/684 418/183 |
| 2013/0164119 | A1* | 6/2013 | Nakaniwa | F04D 29/162 415/173.1 |
| 2013/0259644 | A1* | 10/2013 | Kobayashi | F04D 17/122 415/68 |
| 2015/0308453 | A1 | 10/2015 | Nakaniwa et al. | |
| 2015/0354588 | A1* | 12/2015 | Yamashita | F04D 29/284 415/204 |
| 2016/0319833 | A1* | 11/2016 | Rubino | F04D 29/441 |
| 2017/0292536 | A1 | 10/2017 | Konig | |
| 2017/0306979 | A1* | 10/2017 | Iurisci | F04D 29/441 |
| 2017/0306981 | A1* | 10/2017 | Liu | F04D 25/16 |
| 2018/0306202 | A1* | 10/2018 | Jiang | F04D 29/44 |
| 2018/0347571 | A1* | 12/2018 | Yamashita | F04D 29/286 |
| 2019/0285072 | A1* | 9/2019 | Masutani | F04D 17/12 |
| 2020/0032811 | A1* | 1/2020 | Nakaniwa | F04D 29/422 |

FOREIGN PATENT DOCUMENTS

| | | | |
|---|---|---|---|
| JP | H02-028597 | U | 2/1990 |
| JP | H04-121496 | U | 10/1992 |
| JP | H10-141290 | A | 5/1998 |
| JP | 2009-281155 | A | 12/2009 |
| JP | 2014-167268 | A | 9/2014 |
| JP | 2016-031064 | A | 3/2016 |
| WO | 2014-115417 | A1 | 7/2014 |

OTHER PUBLICATIONS

Written Opinion in corresponding International Application No. PCT/JP2018/043969, dated Feb. 12, 2019 (13 pages).

* cited by examiner

MULTI-STAGE CENTRIFUGAL COMPRESSOR, CASING, AND RETURN VANE

TECHNICAL FIELD

The present invention relates to a multi-stage centrifugal compressor, a casing, and a return vane.

Priority is claimed on Japanese Patent Application No. 2017-229340, filed on Nov. 29, 2017, the content of which is incorporated herein by reference.

BACKGROUND ART

As a centrifugal compressor that is used in an industrial compressor, a centrifugal chiller, a small gas turbine, a pump, or the like, there is known a multi-stage centrifugal compressor including impellers, in each of which a plurality of blades are attached to a disk fixed to a rotary shaft (for example, refer to Patent Document 1). The multi-stage centrifugal compressor applies to pressure energy and speed energy to a working fluid by rotating the impellers. A pair of impellers adjacent to each other in an axial direction of the rotary shaft are connected to a return flow path. The return flow path is provided with a return vane for removing swirling flow components from the working fluid. Furthermore, an introduction flow path which introduces the working fluid to a succeeding stage of the impeller is connected to a downstream side of the return flow path. The introduction flow path is curved from a radial outer side toward a radial inner side as the introduction flow path extends from an upstream side toward a downstream side. Here, in the apparatus described in Patent Document 1, a trailing edge of the return vane is positioned outside a curved portion of the introduction flow path in a radial direction with respect to an axis of the rotary shaft.

CITATION LIST

Patent Literature

[Patent Document 1]

Japanese Unexamined Patent Application, First Publication No. 2009-281155

SUMMARY OF INVENTION

Technical Problem

However, as described above, when the trailing edge of the return vane is positioned outside the curved portion, there is a possibility that the swirling flow components of the working fluid cannot be sufficiently removed. As a result, the swirling flow components increase in the introduction flow path (impeller inlet) positioned closer to the radial inner side than the return vane, based on the law of angular momentum conservation. In addition, the inflow angle (incidence) of the working fluid with respect to the impeller also becomes large. Accordingly, the performance of the multi-stage centrifugal compressor may deteriorate, which is a concern.

The present invention is to provide a multi-stage centrifugal compressor, a casing, and a return vane which are capable of further reducing swirling flow components in a return flow path.

Solution to Problem

According to a first aspect of the present invention, there is provided a multi-stage centrifugal compressor including a rotary shaft that is configured to rotate around an axis; a plurality of stages of impellers that are fixed to the rotary shaft and are configured to integrally rotate to compress and deliver a fluid, which flows into the impellers from an upstream side in an axial direction, to a radial outer side; a casing including a return flow path that is configured to guide the fluid, which is compressed and delivered from an impeller on a preceding stage side, toward a radial inner side, and an introduction flow path that is connected to a downstream side of the return flow path and is configured to divert the fluid and introduce the fluid to an impeller on a succeeding stage side; and; and return vanes that are arranged in the return flow path while being spaced apart from each other in a circumferential direction. The introduction flow path includes an outward curved wall surface that is continuous with a wall surface on a downstream side in the axial direction among wall surfaces forming the return flow path, and is curved toward the downstream side in the axial direction as the radial inner side is approached, and an inward curved wall surface that is continuous with a wall surface on the upstream side in the axial direction among the wall surfaces forming the return flow path, and is curved toward the downstream side in the axial direction as the radial inner side is approached. A first end portion of a trailing edge of the return vane on the downstream side in the axial direction is positioned on the outward curved wall surface, and a second end portion of the trailing edge of the return vane on the upstream side in the axial direction is positioned on the inward curved wall surface within a range of a radial position of the outward curved wall surface.

According to this configuration, the first end portion of the trailing edge of the return vane is positioned on the outward curved wall surface, and the second end portion is positioned on the inward curved wall surface within the range of the radial position of the outer curved wall surface. Accordingly, compared to when the trailing edge is positioned closer to the radial outer side than the outward curved wall surface and the inward curved wall surface, it is possible to more greatly remove the swirling flow components of the fluid flowing through the return flow path. Therefore, it is possible to optimize the inflow angle (incidence) of the fluid with respect to the impeller on the succeeding stage side. Accordingly, it is possible to improve the performance of the multi-stage centrifugal compressor.

According to a second aspect of the present invention, the first end portion and the second end portion may be at the same radial position with respect to the axis.

According to this configuration, the fluid can be straightened over a wider region by the return vane. For this reason, it is possible to reduce the size of a wake (low-speed region) that occurs on the downstream side. Accordingly, an inadvertent loss due to the wake is restrained; and thereby, it is possible to avoid a deterioration in the performance of the multi-stage centrifugal compressor.

According to a third aspect of the present invention, the first end portion and the second end portion may be at the same radial position with respect to the axis as that of a radial innermost end edge of the outward curved wall surface.

According to this configuration, the fluid can be straightened over a wider region by the return vane. For this reason, it is possible to further reduce the size of a wake (low-speed region) that occurs on the downstream side. Accordingly, an inadvertent loss due to the wake is restrained; and thereby, it is possible to avoid a deterioration in the performance of the multi-stage centrifugal compressor.

According to a fourth aspect of the present invention, the first end portion may be positioned at a radial innermost end edge of the outward curved wall surface, and the second end portion may be positioned on the inward curved wall surface at a position corresponding to the radial innermost end edge of the outward curved wall surface.

According to this configuration, the first end portion of the trailing edge of the return vane is positioned at the radial innermost end edge of the outward curved wall surface. The second end portion is positioned on the inward curved wall surface at the position corresponding to the radial innermost end edge of the outward curved wall surface. Accordingly, it is possible to optimize the inflow angle (incidence) of the fluid with respect to the impeller on the succeeding stage side. Therefore, it is possible to improve the performance of the multi-stage centrifugal compressor. Furthermore, the fluid can be straightened over a wider region by the return vane. For this reason, it is possible to further reduce the size of a wake (low-speed region) that occurs on the downstream side. Accordingly, an inadvertent loss due to the wake is restrained; and thereby, it is possible to avoid a deterioration in the performance of the multi-stage centrifugal compressor.

According to a fifth aspect of the present invention, there is provided a casing of a multi-stage centrifugal compressor including a return flow path that is configured to guide a fluid, which is compressed and delivered from an impeller rotating around an axis, toward a radial inner side; an introduction flow path that is connected to a downstream side of the return flow path and is configured to divert the fluid and introduce the fluid to an impeller on a succeeding stage side; and return vanes that are arranged in the return flow path while being spaced apart from each other in a circumferential direction. The introduction flow path includes an outward curved wall surface that is continuous with a wall surface on a downstream side in an axial direction among wall surfaces forming the return flow path, and is curved toward the downstream side in the axial direction as the radial inner side is approached, and an inward curved wall surface that is continuous with a wall surface on an upstream side in the axial direction among the wall surfaces forming the return flow path, and is curved toward the downstream side in the axial direction as the radial inner side is approached. A first end portion of a trailing edge of the return vane on the downstream side in the axial direction is positioned on the outward curved wall surface, and a second end portion of the trailing edge of the return vane on the upstream side in the axial direction is positioned on the inward curved wall surface within a range of a radial position of the outward curved wall surface.

According to a casing of a sixth aspect of the present invention, there is provided a lean vane, a plurality of which are arranged in a return flow path of a multi-stage centrifugal compressor including a plurality of impellers rotating around an axis while being spaced apart from each other in a circumferential direction, in which the return flow path includes an outward curved wall surface that is continuous with a wall surface on a downstream side of the multi-stage centrifugal compressor in an axial direction, and is curved toward the downstream side in the axial direction as a radial inner side is approached, and an inward curved wall surface that is continuous with a wall surface on an upstream side of the multi-stage centrifugal compressor in the axial direction, and is curved toward the downstream side in the axial direction as the radial inner side is approached. A first end portion of a trailing edge on the downstream side in the axial direction is positioned on the outward curved wall surface, and a second end portion of the trailing edge on the upstream side in the axial direction is positioned on the inward curved wall surface within a range of a radial position of the outward curved wall surface.

Advantageous Effects of Invention

According to this invention, it is possible to provide the multi-stage centrifugal compressor capable of further reducing the swirling flow components in the return flow path.

DESCRIPTION OF EMBODIMENTS

Figure 1:
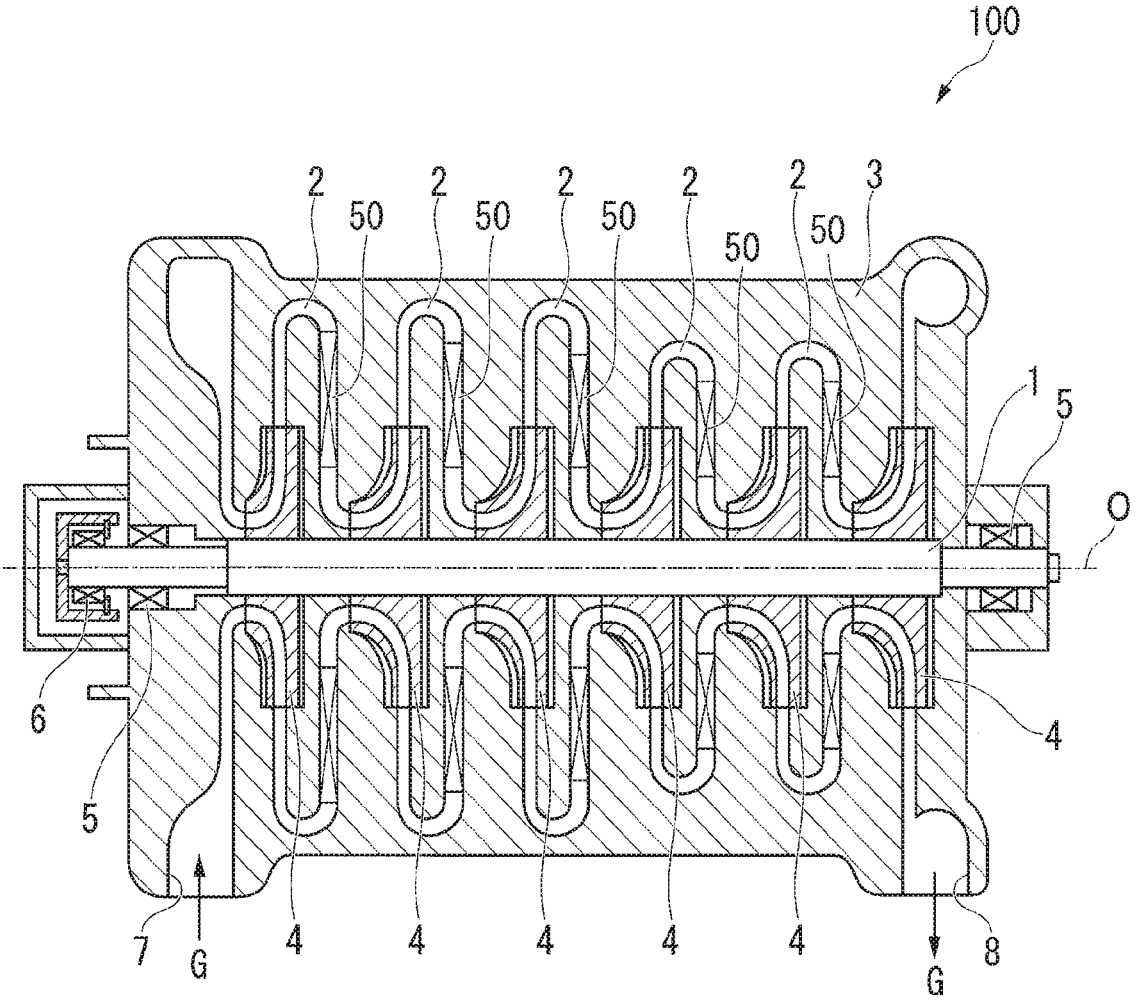
FIG. 1 is a schematic view showing the configuration of a multi-stage centrifugal compressor according to an embodiment of the present invention.

Hereinafter, a centrifugal compressor (multi-stage centrifugal compressor) including a casing and a return vane according to a first embodiment of the present invention will be described with reference to the drawings. As shown in FIG. 1, a centrifugal compressor 100 includes a rotary shaft 1 that is configured to rotate around an axis O, a casing 3 that covers the periphery of the rotary shaft 1 to form a flow path 2, a plurality of stages of impellers 4 provided on the rotary shaft 1, and a return vane 50 provided in the casing 3.

The casing 3 has a cylindrical shape extending along the axis O. The rotary shaft 1 extends to penetrate the inside of the casing 3 along the axis O. A journal bearing 5 and a thrust bearing 6 are provided in both end portions of the casing 3 in the direction of the axis O. The rotary shaft 1 is supported on the journal bearing 5 and the thrust bearing 6 to be able to rotate around the axis O.

An intake port 7 for taking in air as a working fluid G from outside is provided on a first side of the casing 3 in the direction of the axis O. Furthermore, an exhaust port 8 through which the working fluid G compressed inside the casing 3 is exhausted is provided on a second side of the casing 3 in the direction of the axis O.

An internal space through which the intake port 7 communicates with the exhaust port 8 and in which the diameter reduction and the diameter expansion are repeated is formed inside the casing 3. The internal space accommodates the plurality of impellers 4 and forms a part of the flow path 2. Incidentally, in the following description, a side of the flow path 2 where the intake port 7 is positioned is referred to as an upstream side, and a side of the flow path 2 where the exhaust port 8 is positioned is referred to as a downstream side.

Figure 2:
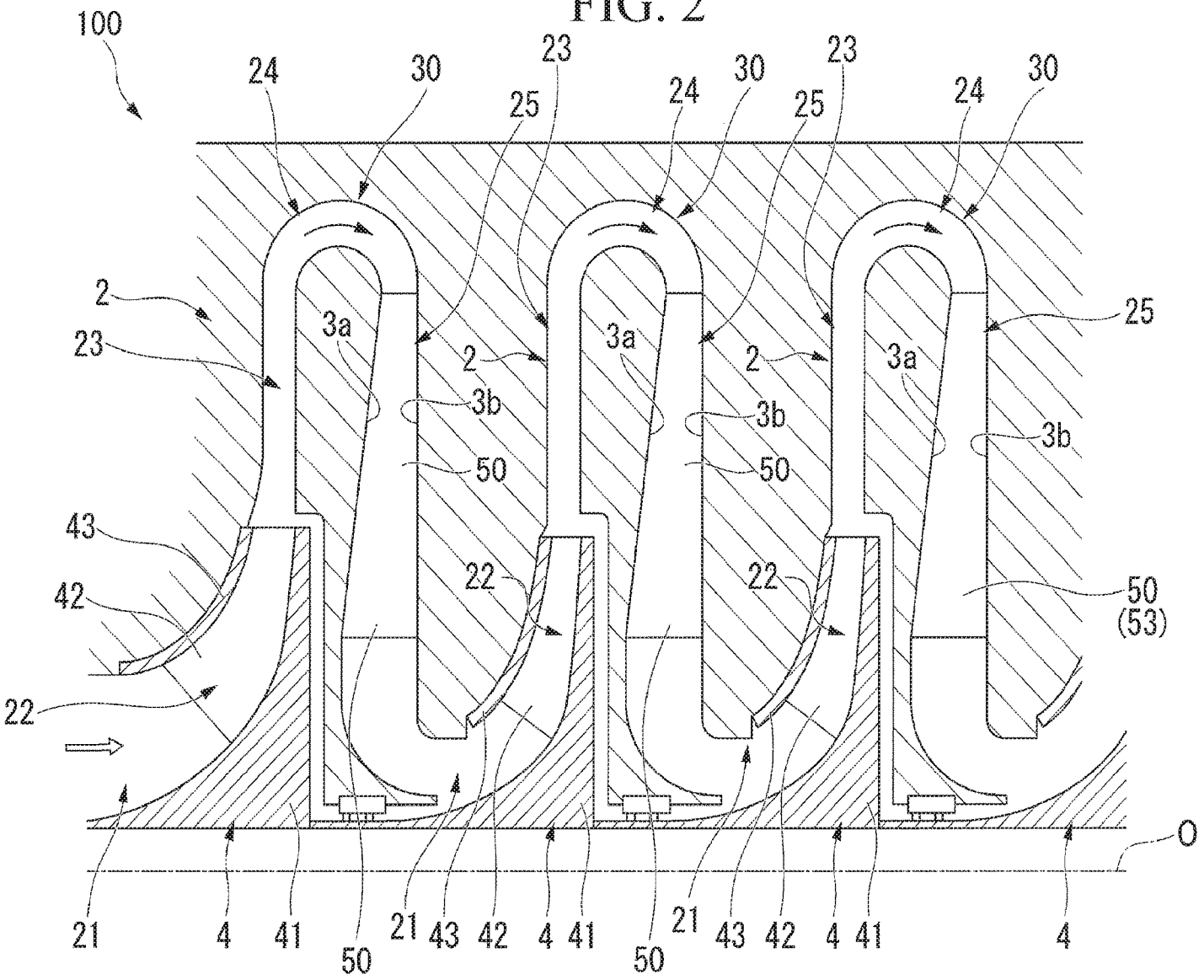
FIG. 2 is an enlarged cross-sectional view of the multi-stage centrifugal compressor according to the embodiment of the present invention.

The plurality (six) of impellers 4 are provided on an outer peripheral surface of the rotary shaft 1 while being spaced apart from each other in the direction of the axis O. As shown in FIG. 2, each of the impellers 4 includes a disk 41 having a substantially circular cross-section as viewed from the direction of the axis O, a plurality of blades 42 provided on an upstream surface of the disk 41, and a cover 43 that covers the plurality of blades 42 from the upstream side.

The disk 41 is formed such that the radial dimension of the disk 41 gradually increases from a first side toward a second side in the direction of the axis O as viewed from a direction intersecting the axis O, and thus the disk 41 has a substantially conical shape. The plurality of blades 42 are radially arranged around the axis O toward a radial outer side on the surface of both surfaces of the disk 41 in the direction of the axis O, the surface facing the upstream side. More specifically, the blade is formed from a thin panel that is erected from the upstream surface of the disk 41 toward the upstream side. The plurality of blades 42 are curved from a first side toward a second side in a circumferential direction as viewed from the direction of the axis O.

The cover 43 is provided at upstream end edges of the blades 42. In other words, the plurality of blades 42 are interposed between the cover 43 and the disk 41 in the direction of the axis O. Accordingly, a space is formed between the cover 43, the disk 41, and a pair of the blades 42 adjacent to each other. The space forms a part of the flow path 2 (compression flow path 22) to be described later.

The flow path 2 is a space through which the impellers 4 configured as described above communicate with the internal space of the casing 3. In the present embodiment, a description will be given based on the assumption that one flow path 2 is formed for one impeller 4 (for one compression stage). Namely, in the centrifugal compressor 100, five flow paths 2 are formed from the upstream side toward the downstream side to correspond to five impellers 4 except for a final stage of the impeller 4.

Each of the flow paths 2 includes an introduction flow path 21, the compression flow path 22, a diffuser flow path 23, and a return flow path 30. Incidentally, FIG. 2 mainly shows the flow paths 2 and first to third stages of the impellers 4 among the impellers 4.

In the first stage of the impeller 4, the introduction flow path 21 is directly connected to the intake port 7. External air as the working fluid G is taken into each flow path of the flow paths 2 by the introduction flow path 21. More specifically, the introduction flow path 21 is gradually curved from a radial inner side toward the radial outer side with respect to the axis O as the introduction flow path 21 extends from the upstream side toward the downstream side.

The introduction flow paths 21 corresponding to the second and succeeding stages of the impellers 4 communicate with a downstream end of a return flow path 25 (to be described later) in a preceding stage (the first stage) of the flow path 2. Namely, similar to as described above, the flow direction of the working fluid G which has passed through the return flow path 25 is changed toward the downstream side along the axis O.

The compression flow path 22 is a flow path surrounded by the upstream surface of the disk 41, a downstream surface of the cover 43, and a pair of the blades 42 that are adjacent to each other in the circumferential direction. More specifically, the cross-sectional area of the compression flow path 22 gradually decreases from the radial inner side toward the radial outer side. Accordingly, the working fluid G flowing through the compression flow path 22 in a state where the impeller 4 rotates is gradually compressed to a high pressure state.

The diffuser flow path 23 is a flow path extending from the radial inner side toward the radial outer side of the axis O. A radial inner end portion of the diffuser flow path 23 communicates with a radial outer end portion of the compression flow path 22.

A return bend portion 24 and the return flow path 25 are formed downstream of the diffuser flow path 23. The flow direction of the working fluid G flowing from the radial inner side toward the radial outer side via the diffuser flow path 23 is reversed toward the radial inner side by the return bend portion 24. One end side (upstream side) of the return bend portion 24 communicates with the diffuser flow path 23, and the other end side (downstream side) of the return bend portion 24 communicates with the return flow path 25. A portion which is positioned on a radial outermost side in the middle of the return bend portion 24 is a top T. Since an inner wall surface of the return bend portion 24 in the vicinity of the top T is a three-dimensional curved surface, the flow of the working fluid G is not disturbed.

The return flow path 25 extends from a downstream end portion of the return bend portion 24 toward the radial inner side. A radial outer end portion of the return flow path 25 communicates with the return bend portion 24. A radial inner end portion of the return flow path 25 communicates with, as described above, the introduction flow path 21 in a succeeding stage of the flow path 2. Among wall surfaces of the casing 3 which forms the return flow path 25, a wall surface on a first side (upstream side) in the direction of the axis O is an upstream wall surface 3*a*. Among the wall surfaces of the casing 3 which forms the return flow path 25, a wall surface on a second side (downstream side) in the direction of the axis O is a downstream wall surface 3*b*.

An end portion on the second side of the return flow path 25 in the direction of the axis O is connected to the introduction flow path 21 that introduces the working fluid G to the impeller 4. Each of the introduction flow paths 21 corresponding to the second and succeeding stages of the impellers 4 is formed by an inward curved wall surface 21*a* positioned on the upstream side and an outward curved wall surface 21*b* positioned on the downstream side. The inward curved wall surface 21*a* is continuous with the upstream wall surface 3*a*. The inward curved wall surface 21*a* has the shape of a curved surface that is curved from the upstream side toward the downstream side as the curved surface extends from the radial outer side toward the radial inner side with respect to the axis O. The outward curved wall surface 21*b* is continuous with the downstream wall surface 3*b*. The outward curved wall surface 21*b* has the shape of a curved surface that is curved from the upstream side toward the downstream side as the curved surface extends from the radial outer side toward the radial inner side with respect to the axis O.

Figure 3:
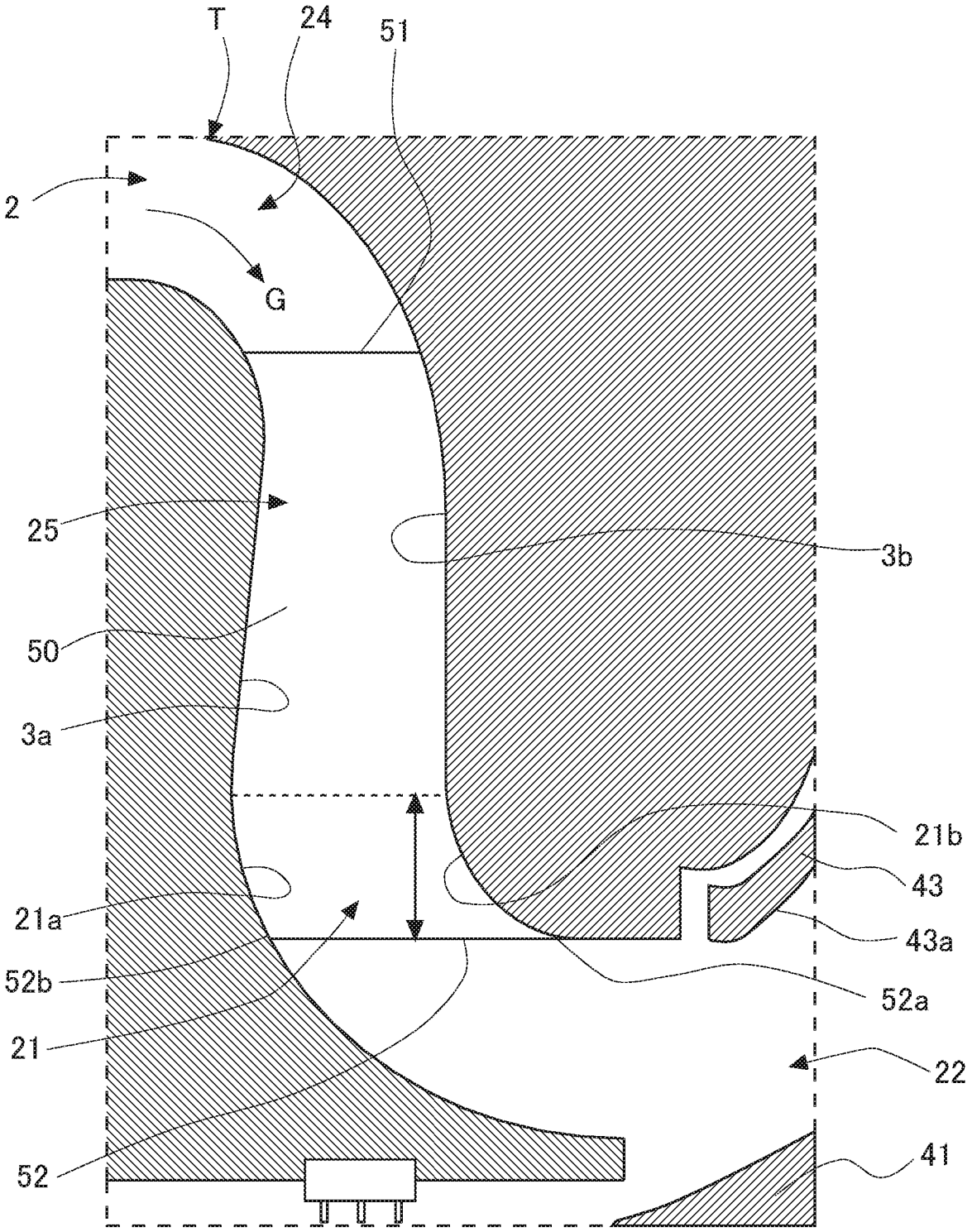
FIG. 3 is an enlarged cross-sectional view showing the vicinity of a return flow path of the multi-stage centrifugal compressor according to the embodiment of the present invention.

Subsequently, the return vane 50 will be described with reference to FIG. 3. A plurality of the return vanes 50 are provided to span the return flow path 25 and the introduction flow path 21. The plurality of return vanes 50 are radially arranged around the axis O. The return vanes 50 are arranged at the periphery of the axis O while being spaced apart from each other in the circumferential direction. Both ends of the return vane 50 in the direction of the axis O are contact with the casing 3 that forms the return flow path 25 and the introduction flow path 21. Namely, a first side (upstream side) of the return vane 50 in the direction of the axis O is in contact with the entire radial range of the upstream wall surface 3*a* and the inward curved wall surface 21*a*. A second side (downstream side) of the return vane 50 in the direction of the axis O is in contact with the entire radial range of the downstream wall surface 3*b* and the outward curved wall surface 21*b*.

The return vane 50 has an airfoil shape, as viewed from the direction of the axis O, of which the radial outer end portion is a leading edge 51 and the radial inner end portion is a trailing edge 52. The return vane 50 extends toward a leading side in a rotational direction of the rotary shaft 1 as the return vane 50 extends from the leading edge 51 toward the trailing edge 52. Incidentally, the leading edge 51 represents a radial outer end edge of the return vane 50. The trailing edge 52 represents a radial inner end edge of the return vane 50. The return return vane 50 is curved to protrude toward the leading side in the rotational direction.

The leading edge 51 of the return vane 50 is provided in the radial outer end portion of the return flow path 25. More specifically, the leading edge 51 is disposed on the boundary between the return bend portion 24 and the return flow path 25. On the other hand, the trailing edge 52 of the return vane 50 is positioned on the introduction flow path 21. The trailing edge 52 extends parallel to the axis O. Incidentally, the term "being parallel" referred to here is not necessarily regarded as being perfectly parallel, and manufacturing errors, intersections, or the like which occur unavoidably are allowed. More specifically, a downstream end portion (first end portion 52*a*) of the trailing edge 52 is positioned at a radial innermost end edge of the outward curved wall surface 21*b* of the introduction flow path 21. The radial position of the first end portion 52*a* is the same as that of a radial innermost end edge of an inner peripheral surface 43*a* of the cover 43. Incidentally, the term "being the same" referred to here is not necessarily regarded as being exactly the same, and manufacturing errors, intersections, or the like which occur unavoidably are allowed.

An upstream end portion (second end portion 52*b*) of the trailing edge 52 is positioned on the inward curved wall surface 21*a* of the introduction flow path 21 within the range of the radial position of the outward curved wall surface 21*b*. More specifically, it is desirable that the second end portion 52*b* is positioned within the range indicated by the bidirectional arrow in FIG. 3. In the present embodiment, as described above, since the trailing edge 52 is parallel to the axis O, the second end portion 52*b* is positioned at the same radial position as that of the radial innermost end edge of the outward curved wall surface 21*b*. Furthermore, since the trailing edge 52 is parallel to the axis O, the second end portion 52*b* is positioned at the same position as that of the radial innermost end edge of the inner peripheral surface 43*a* of the cover 43. Namely, the trailing edge 52 is provided at a position which does not overlap the compression flow path 22 of the impeller 4 in the radial direction with respect to the axis O.

Subsequently, the operation of the centrifugal compressor 100 according to the present embodiment will be described. In driving the centrifugal compressor 100, an external driving source applies a rotating force to the rotary shaft 1. The working fluid G which is taken into the flow path 2 from the intake port as the rotary shaft 1 and the impeller 4 rotate flows into the compression flow path 22 in the impeller 4 via the first stage of the introduction flow path 21. The impeller 4 rotates around the axis O as the rotary shaft 1 rotates. As a result, a centrifugal force is applied to the working fluid G in the compression flow path 22 from the axis O toward the radial outer side. In addition, as described above, the cross-sectional area of the compression flow path 22 gradually decreases from the radial outer side to the radial inner side. As a result, the working fluid G is gradually compressed. Accordingly, a high pressure of the working fluid G is delivered from the compression flow path 22 to the diffuser flow path 23 in the succeeding stage.

Thereafter, the high pressure of the working fluid G which is forcibly delivered from the compression flow path 22 passes through the diffuser flow path 23, the return bend portion 24, and the return flow path 25 in sequence. The same compression is applied also to the second and succeeding stages of the impellers 4 and the flow paths 2. Finally, the working fluid G reaches a desired pressure state and is supplied from the exhaust port 8 to an external device (not shown).

Here, the working fluid G flowing through the return flow path 25 contains swirling flow components that swirl around the axis O in the circumferential direction. More specifically, the swirling flow components swirl from a trailing side toward the leading side in the rotational direction of the rotary shaft 1. The swirling flow components are removed by the return vane 50 provided from the return flow path 25 to the introduction flow path 21. In particular, in the present embodiment, since the trailing edge 52 of the return vane 50 is positioned in the introduction flow path 21, it is possible to more greatly reduce the swirling flow components. Furthermore, since the swirling flow components are sufficiently reduced, it is possible to optimize the inflow angle (incidence) of the working fluid G toward the impeller 4 (compression flow path 22) on a succeeding stage side. Accordingly, an inadvertent loss when the working fluid G flows into the compression flow path 22 is reduced; and thereby, it is possible to improve the performance of the centrifugal compressor 100. In addition, the trailing edge 52 of the return vane 50 extends into the introduction flow path 21. As a result, it is possible to straighten the working fluid G in a wider region from the leading edge 51 to the trailing edge 52. For this reason, it is possible to reduce a wake (low-speed region) that occurs on a trailing edge 52 side.

On the other hand, when the trailing edge 52 of the return vane 50 is not positioned in the introduction flow path 21 but is positioned in the return flow path 25 as in the related art, the working fluid G flows into the introduction flow path 21 in a state where the above-described swirling flow components are not sufficiently removed. In this case, the swirling flow components increase based on the law of angular momentum conservation of the working fluid G. In addition, the inflow angle of the working fluid with respect to the impeller 4 also becomes large. Accordingly, the performance of the centrifugal compressor 100 may deteriorate, which is a concern. However, according to the above-described configuration, it is possible to reduce such a possibility.

As described above, in the centrifugal compressor 100 according to the present embodiment, the first end portion 52*a* of the trailing edge 52 of the return vane 50 is positioned on the outward curved wall surface 21*b*. The second end portion 52*b* is positioned on the inward curved wall surface 21*a* within the range of the radial position of the outward curved wall surface 21*b*. Accordingly, compared to when the trailing edge 52 is positioned closer to the radial outer side than the inward curved wall surface 21*a* and the outward curved wall surface 21*b*, it is possible to more greatly remove the swirling flow components of the working fluid G flowing through the return flow path 25. Therefore, it is possible to optimize the inflow angle (incidence) of the working fluid G with respect to the impeller 4 on the succeeding stage side. Accordingly, it is possible to improve the performance of the centrifugal compressor 100.

In addition, according to the above-described configuration, the first end portion 52*a* of the trailing edge 52 of the return vane 50 is positioned at the radial innermost end edge of the outward curved wall surface 21*b*. The second end portion 52*b* is positioned on the inward curved wall surface 21*a* at the position corresponding to the radial innermost end edge of the outward curved wall surface 21*b*. Accordingly, it is possible to further optimize the inflow angle (incidence)

of the working fluid G with respect to the impeller 4 on the succeeding stage side. Therefore, it is possible to further improve the performance of the centrifugal compressor 100. In addition, the working fluid G can be straightened over a wider region by the return vane 50. For this reason, it is possible to further reduce the size of the wake (low-speed region) that occurs downstream of the return vane 50. Accordingly, an inadvertent loss due to the wake is restrained; and thereby, it is possible to avoid a deterioration in the performance of the centrifugal compressor 100.

Furthermore, the trailing edge 52 is provided at the position which does not overlap the compression flow path 22 of the impeller 4 in the radial direction with respect to the axis O. Accordingly, it is possible to reduce the possibility of turbulences occurring in the working fluid G flowing into the compression flow path 22. In other words, the trailing edge 52 of the return vane 50 according to the present embodiment extends to a radial innermost side without causing turbulences to occur in the working fluid G flowing into the compression flow path 22 (impeller 4).

The embodiment of the present invention has been described above. Incidentally, various changes or improvements can be made to the above-described configuration without departing from the concept of the present invention.

In the present embodiment, the return vane 50 is described as a component independent from the casing 3; however, the return vane 50 may be one component of the casing 3. In this case, the casing 3 includes a casing main body (substantially the same as the casing 3 in the embodiment) and the return vane 50.

Figure 4:
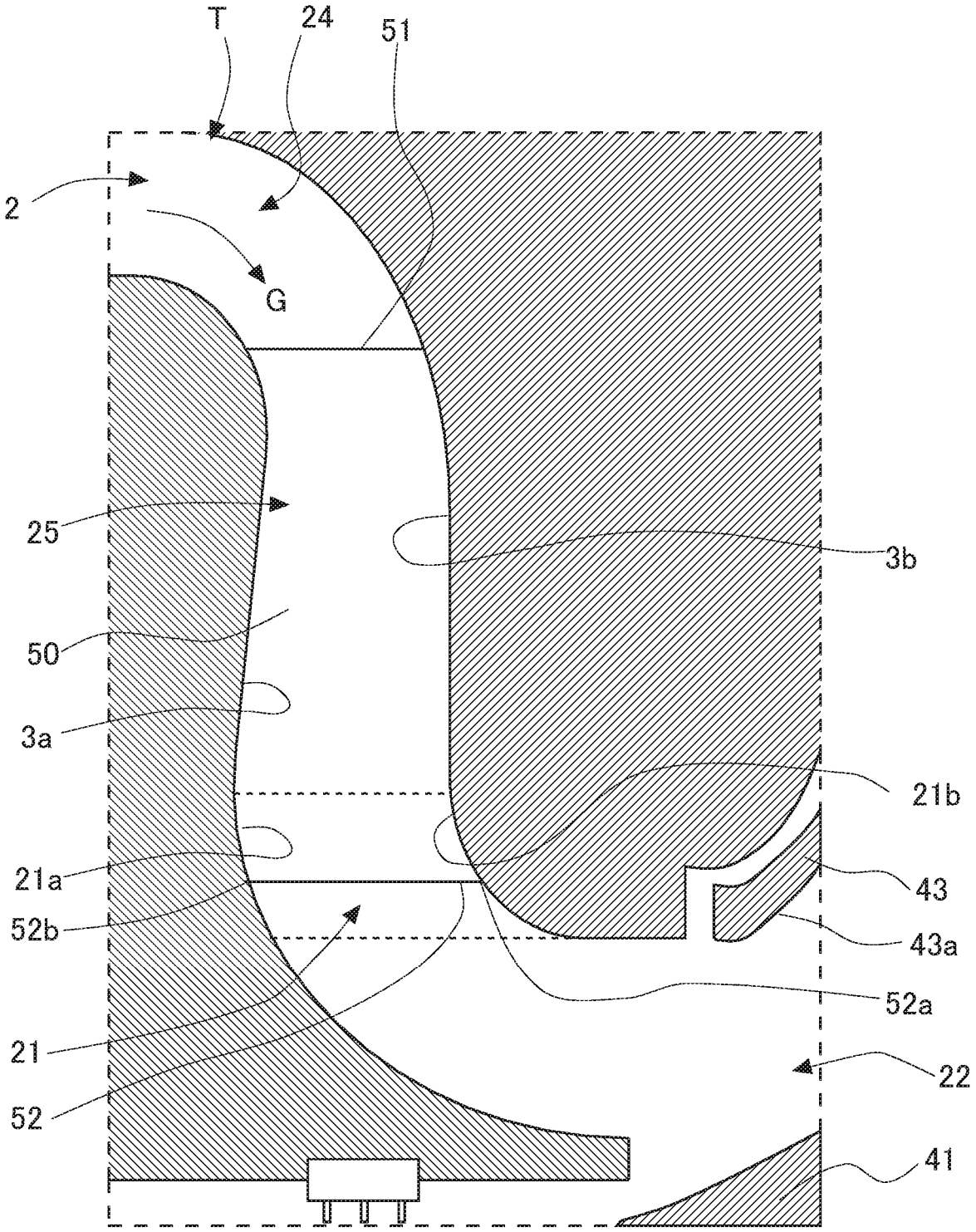
FIG. 4 is an enlarged sectional view showing a modification example of the multi-stage centrifugal compressor according to the embodiment of the present invention.

For example, in the above-described embodiment, the first end portion 52*a* of the trailing edge 52 of the return vane 50 is positioned at the radial innermost end edge of the outward curved wall surface 21*b*. Furthermore, the second end portion 52*b* is positioned on the inward curved wall surface 21*a* at the position corresponding to the radial innermost end edge of the outward curved wall surface 21*b*. However, the position of the trailing edge 52 is not limited to the above position. For example, as shown in FIG. 4, it is possible to adopt a configuration where the first end portion 52*a* and the second end portion 52*b* of the trailing edge 52 are positioned slightly closer to the radial outer side than the radial innermost end edge of the outward curved wall surface 21*b*. In summary, as long as in the trailing edge 52, the first end portion 52*a* is on the outward curved wall surface 21*b* and the second end portion 52*b* is positioned on the inward curved wall surface 21*a* within the range of the radial position of the outward curved wall surface 21*b*, it is possible to appropriately change the position of the trailing edge 52.

INDUSTRIAL APPLICABILITY

According to the present invention, it is possible to further reduce the swirling flow components in the return flow path.

REFERENCE SIGNS LIST

1 Rotary shaft
2 Flow path
3 Casing
3*a* Upstream wall surface
3*b* Downstream wall surface
4 Impeller
5 Journal bearing
6 Thrust bearing
7 Intake port
8 Exhaust port
21 Introduction flow path
21*a* Inward curved wall surface
21*b* Outward curved wall surface
22 Compression flow path
23 Diffuser flow path
24 Return bend portion
25 Return flow path
41 Disk
42 Blade
43 Cover
43*a* Inner peripheral surface of cover
50 Return vane
51 Leading edge
52 Trailing edge
52*a* First end portion
52*b* Second end portion
100 Centrifugal compressor
O Axis
G Working fluid

What is claimed is:

1. A multi-stage centrifugal compressor comprising:

a rotary shaft that is configured to rotate around an axis;

a plurality of stages of impellers that are fixed to the rotary shaft and are configured to integrally rotate to compress and deliver a fluid, which flows into the impellers from an upstream side in an axial direction, to a radial outer side;

a casing including a return flow path that is configured to guide the fluid, which is compressed and delivered from an impeller on a preceding stage side, toward a radial inner side, and an introduction flow path that is connected to a downstream side of the return flow path and is configured to divert the fluid and introduce the fluid to an impeller on a succeeding stage side; and return vanes that are arranged in the return flow path while being spaced apart from each other in a circumferential direction, wherein the introduction flow path includes an outward curved wall surface that is continuous with a wall surface on a downstream side in the axial direction among wall surfaces forming the return flow path, and is curved toward the downstream side in the axial direction as the radial inner side is approached, and an inward curved wall surface that is continuous with a wall surface on the upstream side in the axial direction among the wall surfaces forming the return flow path, and is curved toward the downstream side in the axial direction as the radial inner side is approached, and a first end portion of a trailing edge of the return vane on the downstream side in the axial direction is positioned on the outward curved wall surface, and a second end portion of the trailing edge of the return vane on the upstream side in the axial direction is positioned on the inward curved wall surface within a range of a radial position of the outward curved wall surface.

2. The multi-stage centrifugal compressor according to claim 1, wherein the first end portion and the second end portion are at the same radial position with respect to the axis.

3. The multi-stage centrifugal compressor according to claim 1, wherein the first end portion and the second end portion are at the same radial position with respect to the axis as that of a radial innermost end edge of the outward curved wall surface.

4. The multi-stage centrifugal compressor according to claim 1, wherein the first end portion is positioned at a radial innermost end edge of the outward curved wall surface, and the second end portion is positioned on the inward curved wall surface at a position corresponding to the radial innermost end edge of the outward curved wall surface.

5. A casing of a multi-stage centrifugal compressor comprising:

a return flow path that is configured to guide a fluid, which is compressed and delivered from an impeller rotating around an axis, toward a radial inner side;

an introduction flow path that is connected to a downstream side of the return flow path and is configured to divert the fluid and introduce the fluid to an impeller on a succeeding stage side; and return vanes that are arranged in the return flow path while being spaced apart from each other in a circumferential direction, wherein the introduction flow path includes an outward curved wall surface that is continuous with a wall surface on a downstream side in an axial direction among wall surfaces forming the return flow path, and is curved toward the downstream side in the axial direction as the radial inner side is approached, and an inward curved wall surface that is continuous with a wall surface on an upstream side in the axial direction among the wall surfaces forming the return flow path, and is curved toward the downstream side in the axial direction as the radial inner side is approached, and a first end portion of a trailing edge of the return vane on the downstream side in the axial direction is positioned on the outward curved wall surface, and a second end portion of the trailing edge of the return vane on the upstream side in the axial direction is positioned on the inward curved wall surface within a range of a radial position of the outward curved wall surface.

6. A lean vane, a plurality of which are arranged in a return flow path of a multi-stage centrifugal compressor including a plurality of impellers rotating around an axis while being spaced apart from each other in a circumferential direction, wherein the return flow path includes an outward curved wall surface that is continuous with a wall surface on a downstream side of the multi-stage centrifugal compressor in an axial direction, and is curved toward the downstream side in the axial direction as a radial inner side is approached, and an inward curved wall surface that is continuous with a wall surface on an upstream side of the multi-stage centrifugal compressor in the axial direction, and is curved toward the downstream side in the axial direction as the radial inner side is approached, and a first end portion of a trailing edge on the downstream side in the axial direction is positioned on the outward curved wall surface, and a second end portion of the trailing edge on the upstream side in the axial direction is positioned on the inward curved wall surface within a range of a radial position of the outward curved wall surface.

7. The multi-stage centrifugal compressor according to claim 2, wherein the first end portion and the second end portion are at the same radial position with respect to the axis as that of a radial innermost end edge of the outward curved wall surface.

8. The multi-stage centrifugal compressor according to claim 2, wherein the first end portion is positioned at a radial innermost end edge of the outward curved wall surface, and the second end portion is positioned on the inward curved wall surface at a position corresponding to the radial innermost end edge of the outward curved wall surface.

9. The multi-stage centrifugal compressor according to claim 3, wherein the first end portion is positioned at a radial innermost end edge of the outward curved wall surface, and the second end portion is positioned on the inward curved wall surface at a position corresponding to the radial innermost end edge of the outward curved wall surface.

10. The multi-stage centrifugal compressor according to claim 7, wherein the first end portion is positioned at a radial innermost end edge of the outward curved wall surface, and the second end portion is positioned on the inward curved wall surface at a position corresponding to the radial innermost end edge of the outward curved wall surface.

* * * * *